US006432144B1

(12) United States Patent
Sakuraba et al.

(10) Patent No.: US 6,432,144 B1
(45) Date of Patent: Aug. 13, 2002

(54) METHODS OF TREATING SYNTHETIC FIBERS

(75) Inventors: Shigehiko Sakuraba; Masahiro Nagaya; Yukiko Nagai; Fumihiko Kimura, all of Aichi (JP)

(73) Assignee: Takemoto Yushi Kabushiki Kaisha, Aichi (JP)

( * ) Notice: Subject to any disclaimer, the term of this patent is extended or adjusted under 35 U.S.C. 154(b) by 0 days.

(21) Appl. No.: 09/564,255

(22) Filed: May 4, 2000

(30) Foreign Application Priority Data

Nov. 24, 1999 (JP) ..... 11-332227

(51) Int. Cl.[7] ..... D06M 11/00; D06M 13/322

(52) U.S. Cl. ..... 8/115.51; 8/115.6; 8/116.1; 8/181; 8/116.4; 8/184; 252/8.84

(58) Field of Search ..... 8/115.51, 115.6, 8/116.1, 181, 116.4, 184; 510/276, 281; 252/8.84

(56) References Cited

U.S. PATENT DOCUMENTS 6,143,038 A * 11/2000 Yammamoto et al. ..... 8/115.6
6,271,190 B1 * 8/2001 Boskamp et al. ..... 510/446
6,306,814 B1 * 10/2001 Appel et al. ..... 510/446
6,339,059 B1 * 1/2002 Appel et al. ..... 510/446

* cited by examiner

*Primary Examiner*—Mark Kopec
*Assistant Examiner*—Derrick G. Hamlin
(74) *Attorney, Agent, or Firm*—Beyer Weaver & Thomas LLP

(57) ABSTRACT

An agent containing a lubricant, a non-ionic surfactant and an amphoteric surfactant of a specified kind in specified amounts is applied at a specified rate to spun synthetic fibers before draft and false-twisting processes are simultaneously carried on these fibers such that false-twisted yarns with a high quality without dyeing specks and without abnormal tension variations can be obtained.

8 Claims, No Drawings

METHODS OF TREATING SYNTHETIC FIBERS

BACKGROUND OF THE INVENTION

This invention relates to agents for and methods of treating synthetic fibers. The false-twisting speed for synthetic fibers are increasing fast in recent years. Most recently, false-twisting apparatus equipped with a non-contact type heater are coming to be used to carry out the false-twisting and draft processes simultaneously at a speed exceeding 1000 m/minute. At such a high yarn speed, the friction between the running yarn and guide members, static electricity which is generated on the running yarn and the abrasion of the running yarn against the sludge operate together in a compounded manner, causing abnormal tension variations in the yarn. If such an abnormal tension variation occurs in the running yarn, the false-twisted yarn which is obtained contains unevenness in filament fineness and uneven crystallinity, dyeing specks appearing as a result. Thus, this invention relates to agents for and methods of treating synthetic fibers with and by which occurrence of abnormal tension variations in running yarn can be prevented even during a false-twisting process at a high speed such that high-quality false-twisted yarns without having dyeing specks can be obtained.

Examples of prior art agents for treating synthetic fibers with which false-twisted yarns with good yarn quality can be obtained even by a high-speed false-twisting process include: (1) those having a polyether compound as principal component (Japanese Patent Publications Tokkai 49-31996, 50-155795, 50-199796, 4-24088 and 8-325949 and U.S. Pat. No. 4,044,541); (2) those using a polyether compound together with polyether modified silicon or a fluoride (Japanese Patent Publications Tokkai 60-181368, Tokko 6-21380 and U.S. Pat. No. 4,56,1987); and (3) those using a polyether compound together with an organic salt of organic carboxylic acid anions and quaternary ammonium cations having alkyl group or alkenyl group with 5 or less carbon atoms (Japanese Patent Publication Tokkai 9-111659). If such a prior art agent is used to carry out draft and false-twisting processes simultaneously at a high speed over 1000 m/minute and if, in particular, this is done by using a false-twisting apparatus of a recent type equipped with a non-contact type heater, however, it is not possible to fully prevent the occurrence of tension variations in the running yarn and false-twisted yarns of a sufficiently high quality cannot be obtained.

SUMMARY OF THE INVENTION

The problem, to which the present invention is addressed, is therefore that prior art agents for treating synthetic fibers cannot fully prevent the occurrence of tension variations in the running yarn in a high-speed false-twisting process and only false-twisted yarns of an inferior quality can be obtained.

This invention is based on the present inventors's discovery that the above and other problems can be successfully addressed to if use is made of an agent for the treatment containing a lubricant, a non-ionic surfactant and a specified kind of amphoteric surfactant at a specified ratio and, in particular, if such an agent for the treatment is attached at a specified rate to spun synthetic fibers before they are subjected simultaneously to draft and false-twisting processes.

DETAILED DESCRIPTION OF THE INVENTION

This invention relates firstly to an agent for treating synthetic fibers characterized as containing a lubricant in an amount of 65–94 weight %, a non-ionic surfactant in an amount of 5–20 weight % and an amphoteric surfactant of a specified kind to be described below in an amount of 0.1–5 weight %. The amphoteric surfactant to be thus contained in an agent of this invention is characterized as containing one or two selected from the group consisting of a first kind of amphoteric surfactants (herein referred to as the "carboxybetain type amphoteric surfactants") shown by Formula (1) given below and a second kind of amphoteric surfactants (herein referred to as the "amino acid type amphoteric surfactants") shown by Formula (2) given below:

Formula (1)

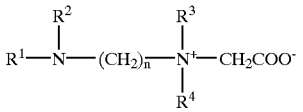

Formula (2)

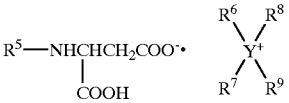

where $R^1$ is alkanoyl group with 8–22 carbon atoms or alkenoyl group with 8–20 carbon atoms; $R^2$ is hydrogen or methyl group; $R^3$ and $R^4$ are each alkyl group with 1–4 carbon atoms; $R^5$ is alkyl group with 8–22 carbon atoms or alkenyl group with 8–22 carbon atoms; $R^6$, $R^7$, $R^8$ and $R^9$ are each alkyl group with 1–4 carbon atoms; Y is N or P; and n is an integer 2 or 3.

This invention relates secondly to a method of treating synthetic fibers characterized as comprising the steps of attaching such an agent as described above to synthetic fibers after they have been spun at a rate of 0.1–3 weight % with respect thereto and thereafter carrying out draft and false-twisting processes simultaneously.

Examples of lubricant to be contained in an agent according to this invention include (1) polyethers; (2) fatty esters; (3) aromatic esters; (4) (poly)ether-esters; and (5) mineral oils.

Examples of the aforementioned polyethers include polyether monols having polyoxyalkylene group in the molecule, polyether diols and polyether triols. Among these, polyethers obtained by random or block addition of alkylene oxide with 2–4 carbon atoms to monohydric-trihydric hydroxy compound are preferred, and mixtures of such polyethers containing polyethers with number average molecular weight 1000–2000 by 10–40 weight %, polyethers with number average molecular weight 2100–3000 by 40–60 weight % and polyethers with number average molecular weight 3100–7000 by 10–30 weight % are particularly preferred.

Examples of the aforementioned fatty esters include (1) esters of fatty monohydric alcohol and fatty monocarboxylic acid such as butyl stearate, octyl stearate, oleyl laurate, oleyl oleate and isopentaeicosanyl isostearate; (2) esters of fatty polyhydric alcohol and fatty monocarboxylic acid such as 1,6-hexanediol didecanoate and trimethylol propane monooleate; and (3) esters of fatty monohydric alcohol and fatty polycarboxylic acid such as dilauryl adipate and dioleyl azelate. Particularly preferred among them are esters of fatty monohydric alcohol and fatty monocarboxylic acid and esters of fatty polyhydric alcohol and fatty monocarboxylic acid with a total of 15–50 carbon atoms.

Examples of the aforementioned aromatic esters include (1) esters of aromatic alcohol and fatty monocarboxylic acid such as benzyl stearate and benzyl laurate; and (2) esters of fatty monohydric alcohol and aromatic carboxylic acid such as diisostearyl isophthalate and trioctyl trimellitate. Particularly preferred among them are esters of fatty monohydric alcohol and aromatic carboxylic acid with a total of 15–50 carbon atoms.

The aforementioned (poly)ether-esters are essentially those obtainable by introducing a (poly)ether part into fatty ester or aromatic ester of the kind described above. Examples of such (poly)ether.ester include (1) (poly) ether.esters with 1–3 ester groups in the molecule obtained by esterifying (poly)ether obtained by adding alkylene oxide with 2–4 carbon atoms to fatty monohydric-trihydric alcohol with 4–26 carbon atoms and fatty carboxylic acid with 4–26 carbon atoms; (2) (poly)ether-esters with 1–3 ester groups in the molecule obtained by esterifying (poly)ether obtained by adding alkylene oxide with 2–4 carbon atoms to aromatic monohydric-trihydric alcohol and fatty carboxylic acid with 4–26 carbon atoms; and (3) (poly)ether-esters with 1–3 ester groups in the molecule obtained by esterifying (poly)ether obtained by adding alkylene oxide with 2–4 carbon atoms to fatty alcohol with 4–26 carbon atoms and aromatic carboxylic acid.

As for mineral oils, many kinds with different viscosity values can be used but those with viscosity $1\times10^{-6}$–$1\times10^{-2}$ $m^2/s$ at 30° C. and paraffin component ratio over 60 weight % are preferred. Examples of such preferred kind of mineral oil include fluid paraffin oils.

Among the agents embodying this invention, those using polyether or a mixture of polyether and (poly)ether esters as the lubricant are preferred.

Examples of non-ionic surfactant to be used according to this invention include (1) non-ionic surfactants having polyoxyalkylene group in the molecule such as polyoxyalkylene alkylether, polyoxyalkylene alkylphenylether, polyoxyalkylene alkylester, polyoxyalkylene caster oil and polyoxyalkylene alkylaminoether; (2) non-ionic surfactants of partial-ester type of a fatty acid with a polyhydric alcohol such as sorbitan monolaurate, sorbitan trioleate, glycerine monolaurate and diglycerine dilaurate; and (3) non-ionic surfactants of ester type of polyoxyalkylene polyhydric alcohol and fatty acid such as those obtained by adding alkylene oxide to partialester of trihydric-hexahydric alcohol and fatty acid, partial and complete esters of trihydric-hexahydric alcohol with alkylene oxide added and an fatty acid and those obtained by adding alkylene oxide to ester of trihydric-hexahydric alcohol and hydroxy fatty acid. Preferred among these are polyoxyalkylene alkylethers containing polyoxyalkylene group with oxyethylene group repeating number 3–15 and alkyl group with 8–18 carbon atoms. Particularly preferred are those containing polyoxyalkylene group with repetition number of oxyethylene groups 4–14 and alkyl group with 10–16 carbon atoms.

The amphoteric surfactant to be used according to this invention is characterized, as explained above, as containing one or two selected from the group consisting of carboxybetain type amphoteric surfactants shown by Formula (1) given above and amino acid type amphoteric surfactants shown by Formula (2) given above. $R^1$ in Formula (1) may be (1) alkanoyl group with 8–22 carbons atoms such as octanoyl group, nonanoyl group, decanoyl group, hexadecanoyl group, octadecanoyl group, nonadecanoyl group, eicosanoyl group, heneicosanoyl group and decisional group; or (2) alkenoyl group with 8–22 carbon atoms such as hexadecenoyl group, eicocenoyl group and octadecenoyl group. Among these, however, alkanoyl groups with 12–18 carbon atoms are preferred. $R^2$ may be hydrogen or methyl group, but hydrogen is preferred. $R^3$ and $R^4$ are each alkyl group with 1–4 carbon atoms such as methyl group, ethyl group, propyl group and butyl group. Among these, however, methyl group is preferred.

Regarding Formula (2) given above, $R^5$ is (1) alkyl group with 8–22 carbon atoms such as octyl group, nonyl group, decyl group, hexadecyl group, octadecyl group, nonadecyl group, eicosyl group, heneicosyl group and docosyl group; or (2) alkenyl group with 8–22 carbon atoms such as hexadecenyl group, eicocenyl group and octadecenyl group. Among these, however, alkyl groups with 12–18 carbon atoms are preferred. The cation group including $Y^+$ of Formula (2) is (1) quaternary phosphonium cation group if Y is P, or (2) quaternary ammonium cation group if Y is N. Examples of quaternary phosphonium cation group include those where $R^6$–$R^9$ in Formula (2) are each alkyl group with 1–4 carbon atoms such as tetramethyl phosphonium, triethylmethyl phosphonium, tripropylethyl phosphonium, tributylmethyl phosphonium and tetrabutyl phosphonium. Among these, however, tetramethyl phosphonium is preferred. Examples of quaternary ammonium cation group include those where $R^6$–$R^9$ in Formula (2) are each alkyl group with 1–4 carbon atoms such as tetramethyl ammonium, triethylmethyl ammonium, tripropylethyl ammonium, tributylmethyl ammonium and tetrabutyl ammonium.

The carboxybetain type amphoteric surfactants shown by Formula (1) given above themselves can be obtained by a known method of synthesis such as described in U.S. Pat. No. 2,082,275, and the amino acid type amphoteric surfactants shown by Formula (2) given above themselves, too, can be obtained by a known method of synthesis such as described in U.S. Pat. No. 2,213,979.

As explained above, the agents embodying this invention for treating synthetic fibers are characterized as containing a lubricant in an amount of 65–94 weight %, a non-ionic surfactant in an amount of 5–20 weight % and an amphoteric surfactant as described above in an amount of 0.1–5 weight % but those containing the amphoteric surfactant in an amount of 0.5–1.5 weight % are preferred. Those containing these three components in a total amount of 90 weight % or more are preferred and those containing them in a total amount of 95 weight % or more are even more preferred.

The agent according to this invention may further contain an antioxidant. Examples of antioxidant which may be contained include triethylene glycol-bis(3-(3-t-butyl-5-methyl-4-hydroxyphenyl)propionate), 1,6-hexanediol-bis(3-(3,5-di-t-butyl-4-hydroxyphenyl)propionate), 2,4-bis-(n-octylthio)-6-(4-hydroxy-3,5-di-t-butylanilino)-1,3,5-triazine, pentaerythrityl-tetrakis(3-(3,5-di-t-butyl-4-hydroxyphenyl)propionate), 2,2-thiodiethylene bis(3-(3,5-di-t-butyl-4-hydroxyphenyl)propionate), octadecyl-3-(3,5-di-t-butyl-4-hydroxyphenyl)propionate, 2,2-thiobis(4-methyl-6-t-butylphenol), 3,5-di-t-butyl-4-hydroxybenzyl phosphonate-diethylester, 1,3,5-tris(4-t-butyl-3-hydroxy-2,6-dimethyl) isocyanic acid and tris(3,5-di-t-butyl-4-hydroxybenzyl) isocyanate. Among these, 1,3,5-tris(4-t-butyl-3-hydroxy-2,6-dimethyl) isocyanic acid and tris(3,5-di-t-butyl-4-hydroxybenzyl) isocyanate are preferred. Such an antioxidant is contained in the agent in an amount of 0.1–3 weight %.

The agent according to this invention may further contain polyether modified silicone. Examples of such polyether modified silicone include those having a polydimethyl siloxane chain with average molecular weight of 1500–3000 as the main chain and a polyoxylalkylene chain with average molecular weight of 700–5000 as a side chain, but those having a polydimethyl siloxane chain with average molecular weight of 2000–2500 as the main chain and a polyoxylalkylene chain with average molecular weight of 1500–3000 as a side chain are preferred. Such polyether modified silicone is contained in the agent in an amount of 0.1–2.5 weight %.

The agent according to this invention may still further contain one or more selected from the group consisting of fatty dibasic acid salts and fatty phosphoric acid salts. Examples of such fatty dibasic acid salt include those having alkyl group with 8–22 carbon atoms and those having alkenyl group with 8–22 carbon atoms. Examples of such fatty phosphoric acid salt include those having alkyl group with 8–22 carbon atoms and those having alkenyl group with 8–22 carbon atoms. Among these, fatty dibasic acid alkali metal salts having alkenyl group with 12–18 carbons atoms, fatty dibasic organic amine salts having alkenyl group with 12–18 carbons atoms, fatty phosphoric acid alkali metal salts having alkenyl group with 12–18 carbons atoms and fatty phosphoric acid organic amine salts having alkenyl group with 12–18 carbons atoms are preferred. Such fatty dibasic acid salts and/or fatty phosphoric acid salts are contained in the agent in an amount of 0.1–1 weight %.

The agent according to this invention may be applied to synthetic fibers in a known form, for example, as a neat oil, a solution with an organic solvent or an aqueous solution. It may be applied during the spinning process or the process in which draft and spinning are done simultaneously. Methods of application include such conventional methods as the roller oiling method, the guide oiling method with a measuring pump, the immersion oiling method and the spray oiling method.

The agent according to this invention is effective if it is made into an aqueous solution form and the synthetic fibers are subjected to a false twisting process simultaneously with the draft process at a high speed after such an aqueous solution is applied to them in an amount of 0.1–3 weight % as the agent. It is effective particularly if the simultaneous draft and false-twisting processes are carried out at a high speed by using a false-twisting apparatus equipped with a non-contact type heater. During such a high-speed false-twisting process, the agent of this invention can prevent the occurrence of abnormal tension variations in the running fibers and hence false-twisted yarns with a high yarn quality without dyeing specks can be obtained. The kinds of synthetic fibers to which the agent of this invention can be applied include polyester fibers, polyamide fibers, polyacryl fibers, polyolefin fibers and polyurethane fibers but the agent of this invention are particularly effective when applied to polyester fibers or polyamide fibers.

The invention is described next in terms of the following seven particular embodiments.

Embodiment 1: Agent containing lubricant (L-1) by 75 weight %, lubricant (L-3) by 10 weight %, non-ionic surfactant (D-1) by 10 weight %, amphoteric surfactant (AD-1) by 0.5 weight %, antioxidant (A-1) by 0.5 weight %, polyether modified silicone (S-1) by 1 weight %, potassium lauryl succinate (LA-1) by 0.5 weight %, diethanol amine lauryl phosphate (LP-1) by 0.5 weight % and ethylene glycol by 2 weight %, where lubricant (L-1) is an mixture of (1) polyether monols with number average molecular weight 1500 obtained by block addition of ethylene oxide and propylene oxide to methyl alcohol, (2) polyether monool with number average molecular weight 2300 obtained by block addition of ethylene oxide and propylene oxide to methyl alcohol and (3) polyether triol with number average molecular weight 5000 obtained by block addition of ethylene oxide and propylene oxide to glycerine at weight ratio of(1)/(2)/(3)=19/58/23, lubricant (L-3) is octyloxy polyethoxy (ethoxy unit repeating number of 6) ethyl decanate, non-ionic surfactant (D-1) is a mixture of (1) polyoxyethylene alkylether having polyoxyethylene group with oxyethylene unit repeating number of 5 and alkyl group with 13 carbon atoms and (2) polyoxyethylene alkylether having polyoxyethylene group with oxyethylene unit repeating number of 10 and alkyl group with 14 carbon atoms at weight ratio of (1)/(2)=50/50, amphoteric surfactant (AD-1) is carboxybetain type amphoteric surfactant of Formula (1) wherein $R^1$ is stearoyl group, $R^2$ is hydrogen, $R^3$ and $R^4$ are each methyl group and n=3, antioxidant (A-1) is 1,3,5-tris (4-t-butyl-3-hydroxy-2,6-dimethyl) isocyanic acid, and polyether modified silicone (S-1) is one having polydimethyl siloxane chain with average molecular weight 2500 as main chain and polyoxyethylene chain with average molecular weight 1500 as side chain.

Embodiment 2: Agent containing lubricant (L-2) by 75 weight %, lubricant (L-4) by 15 weight %, non-ionic surfactant (D-2) by 7 weight %, amphoteric surfactant (AD-2) by 1 weight %, aforementioned antioxidant (A-1) by 0.5 weight %, aforementioned polyether modified silicone (S-1) by 1 weight % and sodium dodecenyl succinate (LA-2) by 0.5 weight %, where lubricant (L-2) is an mixture of (1) polyether monool with number average molecular weight 1500 obtained by random addition of ethylene oxide and propylene oxide to methyl alcohol, (2) polyether monool with number average molecular weight 2300 obtained by random addition of ethylene oxide and propylene oxide to methyl alcohol and (3) polyether triol with number average molecular weight 5000 obtained by random addition of ethylene oxide and propylene oxide to glycerine at weight ratio of (1)/(2)/(3)=35/47/18, lubricant (L-4) is dilauryl polyethoxy (ethoxy unit repeating number of 3) ethyl adipate, non-ionic surfactant (D-2) is a mixture of (1) polyoxyethylene alkylether having polyoxyethylene group with oxyethylene unit repeating number of 5 and alkyl group with 13 carbon atoms and (2) polyoxyethylene alkylether having polyoxyethylene group with oxyethylene unit repeating number of 10 and alkyl group with 14 carbon atoms at weight ratio of (1)/(2)=70/30, and amphoteric surfactant (AD-2) is carboxybetain type amphoteric surfactant of Formula (1) wherein $R^1$ is palmitoyl group, $R^2$ is hydrogen, $R^3$ and $R^4$ are each methyl group and n=3.

Embodiment 3: Agent containing aforementioned lubricant (L-1) by 65 weight %, aforementioned lubricant (L-4) by 15 weight %, aforementioned non-ionic surfactant (D-1) by 15 weight %, amphoteric surfactant (AM-1) by 1 weight %, aforementioned antioxidant (A-1) by 0.5 weight %, polyether modified silicone (S-2) by 1 weight %, diethanol amine lauryl phosphate (LP-1) by 0.5 weight % and diethylene glycol by 2 weight %, where amphoteric surfactant (AM-1) is amino acid type amphoteric surfactant of Formula (2) wherein $R^5$ is stearyl group, Y is P and $R^6$–$R^9$ are each methyl group, and polyether modified silicone (S-2) is one having polydimethyl siloxane chain with average molecular weight 2000 as main chain and polyoxyethylene chain with average molecular weight 3000 as side chain.

Embodiment 4: Agent containing aforementioned lubricant (L-2) by 70 weight %, aforementioned lubricant (L-3) by 10 weight %, aforementioned non-ionic surfactant (D-1) by 14.5 weight %, amphoteric surfactant (AD-3) by 1 weight %, aforementioned antioxidant (A-1) by 0.5 weight %, aforementioned polyether modified silicone (S-1) by 1 weight %, potassium dodecenyl succinate (LA-1) by 0.5 weight %, diethanol amine lauryl phosphate (LP-1) by 0.5 weight % and ethylene glycol by 2 weight %, where amphoteric surfactant (AD-3) is carboxybetain type amphoteric surfactant of Formula (1) wherein $R^1$ is lauroyl group, $R^2$ is hydrogen, $R^3$ and $R^4$ are each methyl group and n=3.

Embodiment 5: Agent containing aforementioned lubricant (L-1) by 80 weight %, aforementioned non-ionic surfactant (D-1) by 17 weight %, amphoteric surfactant (AM-2) by 1 weight %, aforementioned antioxidant (A-1) by 0.5 weight %, aforementioned polyether modified silicone (S-1) by 1 weight %, and sodium dodecenyl succinate (LA-2) by 0.5 weight %, where amphoteric surfactant (AM-2) is amino acid type amphoteric surfactant of Formula (2) wherein $R^5$ is lauryl group, Y is P and $R^6$–$R^9$ are each butyl group.

Embodiment 6: Agent containing aforementioned lubricant (L-2) by 75 weight %, aforementioned non-ionic surfactant (D-2) by 19.5 weight %, amphoteric surfactant (AM-4) by 1.5 weight %, aforementioned antioxidant (A-1) by 0.5 weight %, aforementioned polyether modified silicone (S-2) by 1 weight %, diethanol amine lauryl phosphate (LP-1) by 0.5 weight % and diethylene glycol by 2 weight %, where amphoteric surfactant (AM-4) is amino acid type amphoteric surfactant of Formula (2) wherein $R^5$ is stearyl group, Y is N and $R^6$–$R^9$ are each methyl group.

Embodiment 7: Agent containing aforementioned lubricant (L-1) by 85 weight %, aforementioned non-ionic surfactant (D-2) by 9 weight %, amphoteric surfactant (AM-5) by 1.5 weight %, aforementioned antioxidant (A-1) by 0.5 weight %, aforementioned polyether modified silicone (S-1) by 1 weight %, potassium dodecenyl succinate (LA-1) by 0.5 weight %, diethanol amine lauryl phosphate (LP-1) by 0.5 weight % and ethylene glycol by 2 weight %, where amphoteric surfactant (AM-5) is amino acid type amphoteric surfactant of Formula (2) wherein $R^5$ is lauryl group, Y is N and $R^6$–$R^9$ are each methyl group.

The method according to this invention of treating synthetic fibers is described next as follows:

Embodiment 8: Method of preparing an aqueous solution of one of the agents described above in Embodiments 1–7, causing this aqueous solution to be adhered to spun synthetic polyester fibers at a rate of 0.5 weight % as the agent and thereafter subjecting the fibers simultaneously to draft and false-twisting processes by means of a false-twisting apparatus equipped with a non-contact type heater at the fiber speed of 1000 m/minute.

Next, the invention will be described by way of test examples but it goes without saying that these examples are not intended to limit the scope of the invention. In what follows, "parts" will mean "weight parts" and "%" will mean "weight %".

Part 1: Preparation of Agents for Treating Synthetic Fibers

Test examples("Test") and comparison examples ("Comp.") of agents for treating synthesis fibers were produced. The kinds of amphoteric surfactants used are shown in Tables 1 and 2 with reference to Formulas (1) and (2) and the compositions of the test and comparison examples produced are summarized in Table 3. The symbols used in Table 3, not having been explained above, are as follows:

L-5: Octyl isostearate;

L-6: Fluid paraffin oil with viscosity $2\times10^{-5}$ $m^2/s$ at 30° C.;

D-3: Mixture of (1) polyoxyethylene alkylether having polyoxyethylene group with oxyethylene unit repeating number of 7 and alkyl group with 12 carbon atoms and (2) polyoxyethylene branched alkylether having polyoxyethylene group with oxyethylene unit repeating number of 12 and branched alkyl group with 18 carbon atoms at weight ratio of (1)/(2)=50/50;

Mx-1: Mixture of A-1, S-1, LA-1, LP-1 and AU-1 at weight ratio of 0.5/1/0.5/0.5/2;

MX-2: Mixture of A-1, S-1 and LA-2 at weight ratio of 0.5/1/0.5;

MX-3: Mixture of A-1, S-2, LP-1 and AU-2 at weight ratio of 0.5/1/0.5/0.5/2;

MX-4: Mixture of A-1 and S-1 at weight ratio of 0.5/0.5;

S-2: Polyether modified silicone having polydimethyl siloxane chain with average molecular weight 2000 as main chain and polyoxyethylene chain with average molecular weight 3000 as side chain;

LP-2: Dibutylethanol amine isostearyl phosphate;

AU-1: Ethylene glycol;

AU-2: Diethylene glycol; and aa-1: Tetraethyl ammonium lactate.

TABLE 1

| Kind | $R^1$ | $R^2$ | $R^3$ | $R^4$ | n |
|---|---|---|---|---|---|
| AD-1 | stearoyl group | hydrogen | methyl group | methyl group | 3 |
| AD-2 | palmitoyl group | hydrogen | methyl group | methyl group | 3 |
| AD-3 | lauroyl group | hydrogen | methyl group | methyl group | 3 |
| AD-4 | oleoyl group | methyl group | methyl group | methyl group | 2 |
| ad-1 | hexanoyl group | hydrogen | methyl group | methyl group | 3 |
| ad-2 | lauryl group | methyl group | methyl group | methyl group | 3 |

TABLE 2

| Kind | $R^5$ (group) | Y | $R^6$ (group) | $R^7$ (group) | $R^8$ (group) | $R^9$ (group) |
|---|---|---|---|---|---|---|
| AM-1 | stearyl | P | methyl | methyl | methyl | methyl |
| AM-2 | lauryl | P | butyl | butyl | butyl | butyl |
| AM-3 | oleyl | P | butyl | butyl | butyl | butyl |
| AM-4 | stearyl | N | methyl | methyl | methyl | methyl |
| AM-5 | lauryl | N | ethyl | ethyl | ethyl | ethyl |
| AM-6 | oleyl | N | ethyl | ethyl | ethyl | ethyl |
| am-1 | hexyl | P | methyl | methyl | methyl | methyl |
| am-2 | hexyl | N | methyl | methyl | methyl | methyl |

TABLE 3

| | Agent Composition | | | | | Evaluation | |
|---|---|---|---|---|---|---|---|
| No. | L kind/ ratio | NIS kind/ ratio | AS kind/ ratio | Others kind/ ratio | Amt | *1 | *2 |
| Test. | | | | | | | |
| 1 | L-1/75 L-3/10 | D-1/10 | AD-1/0.5 | MX-1/4.5 | 0.5 | AAA | AAA |
| 2 | L-2/75 L-4/15 | D-2/7 | AD-2/1 | MX-2/2 | 0.5 | AAA | AAA |
| 3 | L-1/65 L-4/15 | D-1/15 | AM-1/1 | MX-3/4 | 0.3 | AAA | AAA |
| 4 | L-2/70 L-3/10 | D-1/14.5 | AD-3/1 | MX-1/4.5 | 0.5 | AAA | AAA |
| 5 | L-1/80 | D-1/17 | AM-2/1 | MX-2/2 | 0.7 | AAA | AAA |

TABLE 3-continued

| | Agent Composition | | | | | Evaluation | |
|---|---|---|---|---|---|---|---|
| No. | L kind/ ratio | NIS kind/ ratio | AS kind/ ratio | Others kind/ ratio | Amt | *1 | *2 |
| 6 | L-2/75 | D-2/19.5 | AM-4/1.5 | MX-3/4 | 0.5 | AAA | AAA |
| 7 | L-1/85 | D-2/9 | AM-5/1.5 | MX-1/4.5 | 0.5 | AAA | AAA |
| 8 | L-1/80 | D-1/15.5 | AD-1/0.5 | MX-4/4 | 0.5 | AA | AA |
| 9 | L-2/85 | D-2/11 | AM-1/1.5 | A-1/2.5 | 0.5 | AA | AA |
| 10 | L-1/60 L-3/25 | D-2/13.5 | AD-1/1.5 | A-2/1 | 0.5 | AA | AA |
| 11 | L-1/85 | D-1/14.5 | AD-4/0.5 | | 0.3 | A | A |
| 12 | L-2/60 L-3/28 | D-2/10.5 | AM-3/1.5 | | 0.7 | A | A |
| 13 | L-5/80 | D-3/19 | AM-6/1 | | 0.4 | A | A |
| 14 | L-6/80 | D-2/19 | AD-4/1 | | 0.6 | A | A |
| Comp. | | | | | | | |
| 1 | L-1/98 | D-1/1.5 | AM-1/0.5 | | 0.5 | C | C |
| 2 | L-1/60 | D-1/38 | AM-1/2 | | 0.5 | B | B |
| 3 | L-1/80 | D-1/19.95 | AM-1/0.05 | | 0.5 | C | C |
| 4 | L-1/80 | D-1/13 | AM-1/7 | | 0.5 | C | C |
| 5 | L-1/94 | D-1/3 | AM-1/3 | | 0.5 | B | B |
| 6 | L-1/74 | D-1/25 | AM-1/1 | | 0.5 | B | B |
| 7 | L-1/80 | D-1/18.5 | ad-1/1.5 | | 9.5 | C | C |
| 8 | L-1/80 | D-1/18.5 | ad-2/1.5 | | 0.5 | B | B |
| 9 | L-1/80 | D-1/18.5 | am-1/1.5 | | 0.5 | C | C |
| 10 | L-1/80 | D-1/18.5 | am-2/1.5 | | 0.5 | C | C |
| 11 | L-1/80 | D-1/18.5 | | aa-1/1.5 | 0.5 | B | B |
| 12 | L-1/80 | D-1/16 | | MX-4/4 | 0.5 | B | B |

where:
L: Lubricant
NIS: Non-ionic surfactant
AS: Amphoteric surfactant
ratio: % contained in agent
Amt: Amount of agent in % attached to synthetic fibers
Evaluation *1: Abnormal tension variation
Evaluation *2: Dyeing specks Part 2: Adhered Amount of Agent, False-Twisting and Evaluation Adhesion of Agent onto Synthetic Fibers Each of the agents as described in Part 1 was uniformly mixed with water to produce a 10% aqueous solution. After polyethylene terephthalate chips with intrinsic viscosity 0.64 and containing titanium oxide by 0.2% were dried by a known method, an extruder was used for spinning at 295° C. Each of the prepared 10% aqueous solutions was applied by a guide oiling method with a measuring pump to the running fibers after they were extruded, cooled and solidified such that the adhered amount (as the agent) became as shown in Table 3. The fibers thus processed were then cohered and wound up at the speed of 4000 m/minute without a mechanical draft to obtain partially oriented yarn (POY) of 76.9 Nm (13tex)-36 filaments in the form of a plurality of 10 kg wound cakes.

False Twisting Process by a False-twisting Apparatus with a High-temperature Short Heater Each of the cakes thus obtained was subjected to a false-twisting process by using a false-twisting apparatus (Model HTS-1500 produced by Teijin Seiki Co., Ltd.) under the following conditions:

Yarn speed=1000 m/minute

Draft ratio 1.685

Twist method=friction with 9 mm polyurethane disk

First heater:

Length=1 m

Entrance temperature=420° C.

Exit temperature=330° C.

Second heater=None

Target twist number=3300 T/m.

Evaluation of Abnormal Tension Variations

An on-line tensor (Model OLT produced by Temco) was set immediately downstream to the twisting section of the aforementioned false-twisting apparatus with a high-temperature short heater to record the variations in the tension of the running yarns. An average value of tension variations was obtained corresponding to 1 ton of POY obtained as aforementioned 10 kg wound cakes, and abnormal tension variations were evaluated according to the standard given below in terms of the number of times of abnormal tension variations relative to this average value.

AAA: No abnormal tension variations greater than the average value ±10%

AA: Abnormal tension variations with magnitude equal to the average value ±10% –±30% occurring once or twice A: Abnormal tension variations with magnitude equal to the average value ±10% –±30% occurring 3–4 times B: Abnormal tension variations with magnitude equal to the average value ±10% –±30% occurring over 5 times C: Occurrence of abnormal tension variations greater than the average value ±30%

Evaluation of Dyeing Specks

A circular knitting machine was used to produce knit fabrics with diameter 70 mm and length 1.2 mm from the same false-twisted yarns on which abnormal tension various were measured. The fabrics thus produced were dyed with a disperse dye (Model Kayalon polyester blue EBL-E produced by Nippon Kayaku Co., Ltd.) by the high-pressure dyeing method. The dyed fabrics were washed with water, subjected to a reduction cleaning process and dried according to a known routine. They were thereafter set on an iron cylinder of diameter 70 mm and length 1 m, and the number of deeply dyed parts on the fabric surfaces were visually counted. The results of the counting were evaluated according to the following standard:

AAA: No deeply dyed parts

AA: 1–2 deeply dyed parts

A: 3–6 deeply dyed parts

B: 7–12 deeply dyed parts

C: Over 13 deeply dyed parts

Table 3 clearly shows that the present invention makes it possible to provide false-twisted yarns with a high quality capable of preventing occurrence of abnormal tension variations not only during a high-speed false-twisting process but also when draft and false-twisting processes are carried out simultaneously at a high speed by using a false-twisting apparatus equipped with a non-contact type heater.

What is claimed is:

1. A method of treating synthetic fibers comprising the steps of:

causing an agent to be adhered to the synthetic fibers so as to be 0.1–3 weight % of spun synthetic fibers; and thereafter simultaneously carrying out draft and false-twisting processes on said spun synthetic fibers;

wherein said agent comprises a lubricant in an amount of 65–94 weight %, a non-ionic surfactant in an amount of 5–20 weight % and an amphoteric surfactant in an amount of 0.1–5 weight %, said amphoteric surfactant consisting of one or two selected from the group consisting of carboxybetain-type amphoteric surfactants shown by Formula (1) given below and amino acid-type amphoteric surfactants shown by Formula (2) given below:

Formula (1)

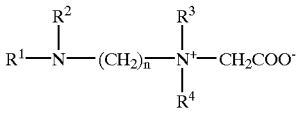

Formula (2)

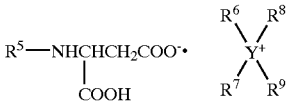

where $R^1$ is alkanoyl group with 8–22 carbon atoms or alkenoyl group with 8–22 carbon atoms; $R^2$ is hydrogen or methyl group; $R^3$ and $R^4$ are each alkyl group with 1–4 carbon atoms; $R^5$ is alkyl group with 8–22 carbon atoms or alkenyl group with 8–22 carbon atoms; $R^6$, $R^7$, $R^8$ and $R^9$ are each alkyl group with 1–4 carbon atoms; Y is N or P; and n is an integer 2 or 3.

2. The method of claim 1 wherein $R^1$ is alkanoyl group with 12–18 carbon atoms, $R^2$ is hydrogen, $R^3$ and $R^4$ are each methyl group and $R^5$ is alkyl group with 12–18 carbon atoms.

3. The method of claim 2 wherein said lubricant consists of polyether mixture or a mixture of polyether mixture and (poly)ether.ester, said polyether mixture being a mixture of first polyether with number average molecular weight 1000–2000 in an amount of 10–40 weight %, second polyether with number average molecular weight 2100–3000 in an amount of 40–60 weight % and third polyether with number average molecular weight 3100–7000 in an amount of 10–30 weight %.

4. The method of claim 3 wherein said non-ionic surfactant is polyoxyethylene alkylether with molecule containing polyoxyalkylene group with oxyethylene group repeating number 3–15 and alkyl group with 8–18 carbon atoms.

5. The method of claim 4 further said agent further comprises antioxidant in an amount of 0.1–3 weight %, polyether modified silicone in an amount of 0.1–2.5 weight % and one or more selected from the group consisting of fatty dibasic acid salts and fatty phosphoric acid salts in an amount of 0.1–1 weight %.

6. The method of claim 1 wherein said draft and false-twisting processes are simultaneously carried out by using a false-twisting apparatus equipped with a non-contact type heater.

7. The method of claim 4 wherein said draft and false-twisting processes are simultaneously carried out by using a false-twisting apparatus equipped with a non-contact type heater.

8. The method of claim 5 wherein said draft and false-twisting processes are simultaneously carried out by using a false-twisting apparatus equipped with a non-contact type heater.

* * * * *